US007906472B2

(12) United States Patent
Park et al.

(10) Patent No.: US 7,906,472 B2
(45) Date of Patent: Mar. 15, 2011

(54) BLEACHING AND DETERGENT COMPOSITIONS COMPRISING MANGANESE COMPLEX PREPARED FROM TETRA-AZA MACROCYCLIC LIGANDS THROUGH A CONVENIENT SYNTHESIS

(75) Inventors: Han Woong Park, Daejeon (KR); Sang Yun Lee, Daejeon (KR); In Sik Cho, Daejeon (KR); Won Jong Kim, Daejeon (KR); In Sub Baik, Seoul (KR)

(73) Assignee: AE Kyung Industrial Co., Ltd. (KR)

( * ) Notice: Subject to any disclaimer, the term of this patent is extended or adjusted under 35 U.S.C. 154(b) by 813 days.

(21) Appl. No.: 11/593,167

(22) Filed: Nov. 3, 2006

(65) Prior Publication Data

US 2007/0072786 A1 Mar. 29, 2007

Related U.S. Application Data

(63) Continuation of application No. PCT/KR2005/001267, filed on May 2, 2005.

(30) Foreign Application Priority Data

May 3, 2004 (KR) ..... 10-2004-0030923

(51) Int. Cl.

| | |
|---|---|
| ***C11D 1/00*** | (2006.01) |
| ***C11D 3/20*** | (2006.01) |
| ***C11D 3/26*** | (2006.01) |
| ***C11D 3/28*** | (2006.01) |
| ***C11D 3/39*** | (2006.01) |
| ***C11D 3/395*** | (2006.01) |

(52) U.S. Cl. ..... 510/311; 510/313; 510/356; 510/360; 510/372; 510/376; 510/378; 510/499; 510/500; 502/200; 502/324

(58) Field of Classification Search ..... 510/311, 510/313, 356, 360, 372, 376, 378, 499, 500; 502/200, 324

See application file for complete search history.

(56) References Cited

U.S. PATENT DOCUMENTS 4,119,557 A 10/1978 Postlethwaite ..... 252/99

(Continued)

FOREIGN PATENT DOCUMENTS

KR 2004-0043576 * 5/2004

OTHER PUBLICATIONS

English Language Machine Translation of KR 2004-0043576 (May 24, 2004).*

(Continued)

*Primary Examiner* — Gregory R Del Cotto

(74) *Attorney, Agent, or Firm* — St. Onge Steward Johnston & Reens LLC

(57) ABSTRACT

The present invention provides a bleach activator which is at least one macrocyclic manganese complex selected from the group consisting of $[Mn^{III}(rac\text{-}14\text{-decane})X_2]Y$, $[Mn^{III}(mes\text{-}14\text{-decane})X_2]Y.H_2O$ and $[Mn^{III}(mes\text{-}14\text{-decane})X_2]Y$ represented by Formulas 1-3, as well as a preparation method thereof. Also, the invention provides a bleaching composition and bleaching detergent composition comprising the bleach activator. The bleach activator comprising the manganese complex is used in a granulated form.

[Formula 1]

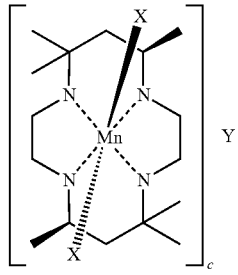

$[Mn^{III}(rac\text{-}14\text{-decane})X_2]Y$

[Formula 2]

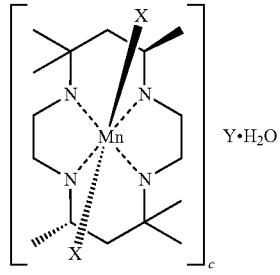

$[Mn^{III}(mes\text{-}14\text{-decane})X_2]Y{\cdot}H_2O$

[Formula 3]

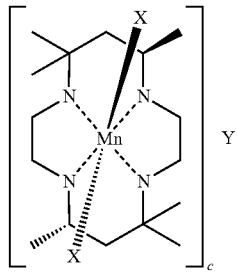

$[Mn^{III}(mes\text{-}14\text{-decane})X_2]Y$ wherein X is at least one selected from chlorine (—Cl) and acetate (—$OOCCH_3$), and Y is an anion selected from $Cl^-$, $Br^-$, $F^-$, $NO_3^-$, $ClO_4^-$, $OH^-$, $NCS^-$, $N_3^-$, and $PF_6^-$.

1 Claim, No Drawings

U.S. PATENT DOCUMENTS

| | | | | |
|---|---|---|---|---|
| 4,430,243 | A | 2/1984 | Bragg | 252/91 |
| 5,246,612 | A | 9/1993 | Van Dijk et al. | 252/102 |
| 5,246,621 | A | 9/1993 | Favre et al. | 252/186.33 |
| 5,837,663 | A * | 11/1998 | Nicholson et al. | 510/226 |
| 5,942,152 | A | 8/1999 | Tafesh et al. | 252/186.39 |
| 6,566,318 | B2 | 5/2003 | Perkins et al. | 510/310 |
| 6,667,288 | B2 | 12/2003 | Burns et al. | 510/311 |

OTHER PUBLICATIONS

English Language Abstract of KR 2004-0043576 (May 24, 2004).*
International Search Report, Aug. 11, 2005, 2 pages.
Written Opinion of the International Searching Authority, Aug. 11, 2005, 4 pages.
N.F. Curtis & R.W. Hay, "A Novel Heterocycle Synthesis. Formation of 5,7,7,12,14,14—Hexamethyl—1,4,8,11—tetra—azacyclotetradeca—4,11—diene Dihydroperchlorate by Reaction of Diaminoethane Monohydroperchlorate by Reaction of Diaminoethane Monohydroperchlorate with Mesityl Oxide or Acetone", Chemical Communications, 1966, 2 pages.
Philip S. Bryan et al., "Synthesis and Characterization of Manganese Complexes Containing a Synthetic Macrocyclic Ligand", Inorganic Chemistry, vol. 14 No. 2, 1975, 4 pages.
R.W. Hay & G.A. Lawrence, "Transition—metal Complexes of the MacrocyclicLigand 5,12—Dimethyl-1,4,8,11—tetra—azacyclotetradeca—4,11—diene", Jorurnal of Chemical Society Perkin I, 1975, 6 pages.

* cited by examiner

BLEACHING AND DETERGENT COMPOSITIONS COMPRISING MANGANESE COMPLEX PREPARED FROM TETRA-AZA MACROCYCLIC LIGANDS THROUGH A CONVENIENT SYNTHESIS

CROSS-REFERENCE TO RELATED APPLICATIONS

The present application is a continuation of pending International patent application PCT/KR2005/001267, filed May 2, 2005, which designates the United States and claims priority from Korean patent application no. 10-2004-0030923, filed May 3, 2004, the content of which is incorporated herein by reference.

FIELD OF THE INVENTION

The present invention relates to a tetra-aza macrocyclic ligand for use in preparing a bleach activator, a method for the convenient synthesis of the ligand, and a bleaching composition and bleaching detergent composition comprising a manganese complex prepared by the ligand. More particularly, the present invention relates to a macrocyclic manganese complex as a bleach activator for activating hydrogen peroxide and hydrogen peroxide generated by a peroxide in an aqueous solution, and to a method for the convenient synthesis of a tetra-aza microcyclic ligand for use in preparing the macrocyclic manganese complex, as well as the use of the synthesized complex, i.e., a bleaching composition and bleaching detergent composition comprising the macrocyclic manganese complex.

BACKGROUND OF THE INVENTION

Generally, bleaches are classified into chlorine-based bleaches and oxygen-based bleaches. The chlorine-based bleaches have limitations in the use thereof since they decolorize the dyes of clothes or have a unique irritating odor. Thus, the oxygen-based bleaches without such drawbacks are generally used as bleaches or detergents for clothes.

For the oxygen-based bleaches, liquid hydrogen peroxide has long been used in liquid bleaches, and solid sodium perborate (NaBO3.H2O, NaBO3.4H2O) and sodium percarbonate (2Na2CO3.3H2O2) have long been used in powder bleaches or detergents. However, oxygen-based bleaches, such as sodium perborate, sodium percarbonate and hydrogen peroxide, are inferior in bleaching ability to the chlorine-based bleaches and have relatively low bleaching performance at low temperature, and thus, can exhibit a sufficient bleaching effect only at a temperature of more than 60° C. If these inorganic peroxides are used at a lower temperature than 60° C., their oxidizing ability can be enhanced by the addition of bleach activators, such as acyls or esters. However, such prior bleach activators are disadvantageous in that they should be generally compounded in stoichiometrically equal or greater amounts. Furthermore, the prior bleach activators have a disadvantage in that their efficiency is remarkably reduced at a washing temperature of about 20° C., which is the washing environment in Korea.

It has been known in the prior art that general transition metal ions catalyze the decomposition of hydrogen peroxide and a peroxide generating hydrogen peroxide in an aqueous solution. In view of this fact, there have been efforts to solve the problem of the prior bleach activators and to develop effective bleach activators which can show sufficient bleaching ability even at a low temperature of about 20° C. U.S. Pat.

Nos. 4,119,557 and 4,430,243 disclose methods of using transition metal ions together with chelating agents, to activate peroxide. However, all combinations of transition metal ions and chelating agents are not regarded to be effective in activating the oxygen-based bleaches. It is known in fact that many combinations of transition metal ions and chelates have no bleaching effects or show adverse effects.

Accordingly, in order to use transition metals as activating catalysts in bleaching compositions and bleaching detergent compositions, it is particularly important to find out metal catalysts which do not cause irreversible oxidations and decompose peroxides in only a pathway of bleaching.

In this viewpoint, attempts to use transition metal compounds, particularly complexes comprising manganese and cobalt, as bleaching catalysts, are recently made. For example, U.S. Pat. No. 5,246,621 discloses a binuclear manganese complex with a 1,4,7-trimethyl-1,4,7-triazacyclononane ligand. This transition metal complex can be used to wash fabrics using suitable inorganic peroxides. However, this complex has problems in that it is very expensive due to a difficult synthesis thereof, and causes excessive bleaching to damage fibers or to decolorize dyes, when the catalyst is used in an excessive amount. In the usual laundry practice of customers, a detergent is put onto the laundry to which water is then added. Thus, an excessive amount of the detergent component can exist on a portion of clothes, in which case if an excessive amount of the bleaching catalyst exists to cause excessive bleaching, fiber damage or dye fading can occur.

SUMMARY OF THE INVENTION

Accordingly, the present invention has been made to solve the above-mentioned problems occurring in the prior art. The present invention provides a bleach activator which is synthesized in a relatively easy and inexpensive manner, is stable to hydrolysis, oxidation, reduction and the like, does not cause fiber damage or dye decolorization, and has an excellent bleaching effect even at low temperature, as well as a preparation method thereof.

The present invention also provides a bleaching composition and bleaching detergent composition comprising said bleach activator.

The present inventors have synthesized racemic-5,5,7,12,12,14-hexamethyl-1,4,8,11-tetraazacyclotetradecane (hereinafter, referred to as "rac-14-decane") of Formula 4 and meso-5,5,7,12,12,14-hexamethyl-1,4,8,11-tetraazacyclotetradecane (hereinafter, referred to as "mes-14-decane") of Formula 5 at high yields, and found that the use of said compounds as ligands allows relatively easy synthesis of manganese complexes of Formulas 1-3, and the use of such macrocyclic manganese complexes provides a remarkable improvement in the bleaching ability of peroxides and does not cause excessive bleaching even when used in an excessive amount. On the basis of these findings, the present invention has been completed.

Accordingly, the present invention discloses the inventive bleach activator that is an manganese complex for activating hydrogen peroxide and hydrogen peroxide generated from a peroxide, the bleach activator being selected from macrocyclic manganese complexes, including $[Mn^{III}(\text{rac-14-decane})X_2]Y$, $[Mn^{III}(\text{mes-14-decane})X_2]Y.H_2O$, and $[Mn^{III}(\text{mes-14-decane})X_2]Y$ represented by Formulas 1-3, respectively:

[Formula 1]

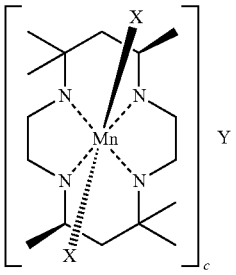

$[Mn^{III}(rac\text{-}14\text{-}decane)X_2]Y$

[Formula 2]

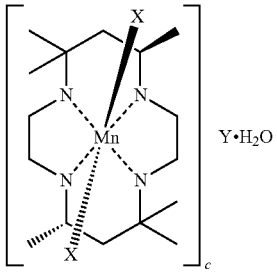

$[Mn^{III}(mes\text{-}14\text{-}decane)X_2]Y{\bullet}H_2O$

[Formula 3]

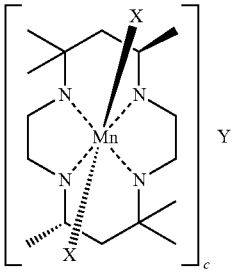

$[Mn^{III}(mes\text{-}14\text{-}decane)X_2]Y$ wherein X is at least one selected from chlorine (—Cl) and acetate (—$OOCCH_3$), Y is an anion selected from Cl—, Br—, F—, $NO_3$—, $ClO_4$—, OH—, NCS—, $N_3$—, and $PF_6$—.

The present invention also discloses a bleaching composition comprising 1-99% by weight of peroxide and an effective amount of the macrocyclic manganese complex as a bleach activator.

The present invention also discloses a bleaching detergent composition comprising 0.001-5% by weight of the macrocyclic manganese complex as a bleach activator.

The bleach activator according to the present invention is preferably granulated in view of stability and utility, and the detergent composition preferably comprises 1-40% by weight of sodium percarbonate or sodium perborate as inorganic peroxide.

DETAILED DESCRIPTION OF THE INVENTION

Hereinafter, the action and effect of the inventive macrocyclic manganese complexes as bleach activators will be described in detail.

The present invention provides macrocyclic manganese complexes as bleach activators, such as $[Mn^{III}(rac\text{-}14\text{-}decane)X_2]Y$, $[Mn^{III}(mes\text{-}14\text{-}decane)X_2]Y.H_2O$ and $[Mn^{III}(mes\text{-}14\text{-}decane)X_2]Y$ represented by Formulas 1-3, respectively.

The above-described manganese complexes as bleach activators act to activate oxygen-based bleaches generating hydrogen peroxide. These macrocyclic manganese complexes are bleach activators which are stable to hydrolysis, oxidation and reduction and have an excellent ability to activate bleaching agents even at low temperature. Also, they have an advantage in that they do not cause excessive bleaching even when added in an excessive amount.

Thus, the bleach activators of the present invention show a beneficial effect of improving the bleaching ability of bleaches and bleaching detergents even when they are used in a small amount together with bleaches, such as hydrogen peroxide, inorganic peroxides generating hydrogen peroxide in an aqueous solution, peracids and their salts.

As described above, manganese-containing transition metal complexes according to the present invention have been studied for purposes having no connection with bleaching. For example, a synthesis method of $[Mn^{III}Cl_2(14\text{-}decane)]X$ (X=$PF_6$—, $BF_4$—) is described in the literature (Philip S. Bryan et al., "Synthesis and Characterization of Manganese complexes Containing a synthetic macrocyclic Ligand", Inorganic Chemistry, Vol. 14, No. 2, 1975, 296), but this complex is difficult to synthesize and also there was no recognition that this complex can act as a remarkably efficient bleach activator for peroxide.

Also, the literature (N. F. Curtis and R. W. Hay, Chem. Comm., 1966, No. 15, 524-525) or the literature (R. W. Hay and G. A. Lawrance, Journal of Chemical Society Perkin 1, 1975, 591-593) suggests methods for synthesizing ligands of Formulas 4 and 5. However, the former case has significant risk and low yield due to the use of perchloric acid ($HClO_4$) in a step of ligand synthesis, and the latter case provides an improvement in yield by the use of bromic acid (HBr) but also involves troublesomeness and significant risk due to direct reaction of sodium borohydride ($NaBH_4$) into methanol solution.

Accordingly, the present invention provides a method capable of reducing ligands at high yield in a safer manner, the method comprising the steps of: suspending 14-deca-4, 11-diene of Formula 6 in water and adding dropwise to the suspension an aqueous alkaline solution of sodium borohydride of pH 9 or higher, at a temperature of 0° C. to 10° C. with stirring; maintaining the stirred solution at more than 50° C. for at least 30 minutes; and cooling the heated solution to ambient temperature and then adding an aqueous alkaline solution of pH 9 or higher to the cooled solution again so as to precipitate the product.

In another aspect, the present invention provides a bleaching composition comprising 1-99% by weight of peroxide and, as a bleach activator, an effective amount of at least one macrocyclic manganese complex selected from the group consisting of $[Mn^{III}(rac\text{-}14\text{-}decane)X_2]Y$, $[Mn^{III}(mes\text{-}14\text{-}decane)X_2]Y.H2O$ and $[Mn^{III}(mes\text{-}14\text{-}decane)X_2]Y$ represented by Formulas 1-3, respectively.

In this respect, the macrocyclic manganese complex is preferably used in a granulated form rather than using it as it is. Thus, the granulated bleach activator is prepared by mixing the following components: a) 1-30% by weight of a binder; b) 10-90% by weight of a filler; c) 10-60% by weight of a disintegrant; and d) 0.01-50% by weight (preferably 1-30% by weight) of the macrocyclic manganese complex. Also, the granulated bleach activator is prepared by coating with post-coating powder and the like. The post-coating powder is used in an amount of 1-20% by weight.

The binder may be at least one selected from polyethyleneglycol (PEG), polyvinylpyrrolidone (PVP), and ethyleneoxide nonionic surfactants, and the filler may be at least one selected from inorganic salts, such as sodium carbonate ($Na_2CO_3$), sodium chloride (NaCl), sodium sulfate ($Na_2SO_4$), and the like. Also, the disintegrant may be at least one selected from silica, sodium carboxylmethylcellulose (SCMC), and hydroxypropylmethylcellulose (HPMC). Finally, the post-coating agent may be at least one selected from zeolite-4A, titanium dioxide ($TiO_2$) and the like. The diameter of final dried granules passed through a fluidized bed dryer is 100-2000 μm, and preferably 300-1500 μm.

The peroxides generating hydrogen peroxide include inorganic peroxides, such as alkali metal perborate, percarbonate and persulfate, and organic peroxides, such as urea peroxide. Organic peracids and their salts may also be used as the peroxides, but sodium percarbonate, sodium perborate monohydrate and sodium perborate tetrahydrate are preferred in terms of cost, performance and safety. These peroxides may also be used in a mixture of two or more of the above-listed peroxides.

In another aspect, the present invention provides a bleaching detergent composition comprising a peroxide, a surfactant, a builder and a bleach activator, the bleach activator being at least one macrocyclic manganese complex selected from the group consisting of $[Mn^{III}(\text{rac-14-decane})X_2]Y$, $[Mn^{III}(\text{mes-14-decane})X_2]Y.H_2O$ and $[Mn^{III}(\text{mes-14-decane})X_2]Y$ represented by Formulas 1-3, respectively.

The bleaching detergent composition preferably comprises 1-40% by weight of sodium percarbonate or sodium perborate as inorganic peroxide, and the macrocyclic manganese complex may be compounded in an amount of 0.001-5% by weight based on the detergent composition.

Examples of surfactants which can be used in the composition include an anionic surfactant, a nonionic surfactant and soap. The anionic surfactant may be at least one selected from alkylbenzene sulfonate, alkyl sulfonate, alkyl ether sulfonate, alkane sulfonate, and olefin sulfonate. The nonionic surfactant may be at least one selected from straight chain and branched chain alkylpolyethoxy alcohols, alkylpolyethoxy fatty acid ester, and fatty acid alkanolamides. The total content of the surfactants is preferably 1-50% by weight based on the composition.

Examples of the builder used in the composition include inorganic builders and organic builders, and are used in an amount of 1-90% by weight. Examples of the inorganic builders include sodium carbonate, sodium tripolyphosphate, aluminosilicates such as natural or synthetic zeolites, sodium silicate and sodium sulfate, and examples of the inorganic builders include sodium polyacrylate, polymaleate and citrate.

The inventive bleaching detergent composition may comprise an additional bleach activator in addition to the macrocyclic manganese complex, and examples of the additional bleach activator include, but are not limited to, acyls such as tetraacetylethylenediamine (hereinafter, referred to as "TAED"), esters such as sodium alkanoyloxybenzenesulfonate, kenones, amides, and nitriles.

In addition, the inventive bleaching detergent composition may comprise additives generally used in powder detergents, such as fluorescents, enzymes, perfumes, and chelating agents.

In the present invention, tetra-aza macrocyclic ligands represented by Formulas 4 and 5, which are the ligands of the macrocyclic manganese complexes represented by Formulas 1-3, may first be prepared.

[Formula 4]

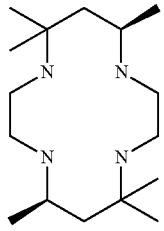

rac-14-decane

[Formula 5]

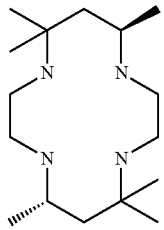

mes-14-decane

Preparation 1: Synthesis of 5,7,7,12,14,14-hexamethyl-1,4,8,11-tetraazacyclotetradeca-4,11-diendihydrobromide dihydrate(14-deca-4,11-diene)

According to the method described in the literature (R. W. Hay, G. A. Lawrance, Journal of Chemical Society Perkin I, 1975, 591-593), 5,7,7,12,14,14-hexamethyl-1,4,8,11-tetraazacyclotetradeca-4,11-diendihydrobromide dihydrate (14-deca-4,11-diene) was synthesized.

Elemental analysis for $C_{16}H_{36}N_4.2HBr.2H_2O$:

Calculated: C, 40.2; H, 8.0; N, 11.7.

Found: C, 40.3; H, 7.8; N, 11.9.

[Formula 6] 14-deca-4,11-diene

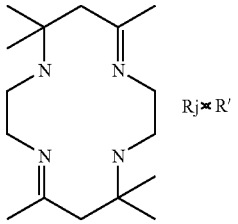

| Compound | R | R' |
|---|---|---|
| A | 2HBr | |
| B | 2HBr | $2H_2O$ |
| C | $2HClO_4$ | |
| D | $2HClO_4$ | $2H_2O$ |

Preparation 2: Synthesis of 5,5,7,12,12,14-hexamethyl-1,4,8,11-tetraazacyclotetradecane(14-decane)

18 g of 14-deca-4,11-diene was suspended in 60 ml of $H_2O$, and 3 g of sodium borohydride ($NaBH_4$) and 0.06 g of NaOH were dissolved in 20 ml of $H_2O$. Then, the solution was added dropwise to the suspension at a temperature of 0° C. to 10° C. while stirring for one hour. Here, bubbles generated at this time was controlled using an antifoaming agent. The stirred solution was heated above 50° C. for 30 minutes and cooled to ambient temperature. To the cooled mixture, a solution of 8 g of NaOH in 20 ml of $H_2O$ was added, followed by stirring for about 1 hour. The stirred solution was cooled to 0° C. so as to produce a white solid, and this precipitate was filtered followed by washing, thus synthesizing white crystalline 14-decane.

Elemental analysis for $C_{16}H_{36}N_4$:
Calculated: C, 67.55; H, 12.75; N, 19.69.
Found: C, 68.10; H, 12.55; N, 19.35.

Preparation 3: Separation of 5,5,7,12,12,14-hexamethyl-1,4,8,11-tetraazacyclotetradecane(14-decane)

28 g of 14-decane was dissolved in 400 ml of MeOH and hot filtered to remove impurities. The filtrate was added with 300 ml of distilled water, followed by cooling to ambient temperature. The produced solid was filtered and sufficiently washed with cold distilled water to obtain mes-14-decane. 10 g of KOH was added into the filtrate so as to precipitate a solid which was then filtered, thus obtaining rac-14-decane.

Preparation 4: Synthesis of $[Mn^{III}(\text{rac-14-decane})Cl_2]ClO_4$ 1.692 g of rac-14-decane was dissolved in 50 ml of methanol, and to this solution, an addition of 1.2 g of $MnCl_2.4H_2O$ in 100 ml of methanol gave rise to a dark brown solution. The formed solution was stirred for 24 hours with the injection of air, followed by filtration. To this filtrate, concentrated hydrochloric acid and concentrated perchloric acid were added to form a greenish solid. The solid was filtered and washed with methanol, thus synthesizing greenish $[Mn^{III}(\text{rac-14-decane})Cl_2]ClO_4$.

IR (KBr, $cm^{-1}$): 3157, 2971, 1629, 1172, 1104, 1000, 624
Elemental analysis for $C_{16}H_{36}N_4MnCl_3O_4$:
Calculated: C, 37.70; H, 7.12; N, 10.99.
Found: C, 37.83; H, 7.44; N, 10.89.

Preparation 5: Synthesis of $[Mn^{III}(\text{mes-14-decane})Cl_2]ClO_4.H_2O$ 1.692 g of mes-14-decane was dissolved in 50 ml of methanol, and to the solution, an addition of 1.482 g of $Mn(CH_3COO)_2.4H_2O$ in 50 ml of methanol gave rise to a dark brown solution. This solution was stirred for 24 hours with the injection of air. To the stirred solution, concentrated hydrochloric acid and concentrated perchloric acid were added to produce a greenish solid. The solid was filtered and washed with methanol, thus synthesizing greenish $[Mn^{III}(\text{mes-14-decane})Cl_2]ClO_4.H_2O$.

IR (KBr, cm-1): 3587, 3144, 2973, 1424, 1104, 1000, 624
Elemental analysis for $C_{16}H_{36}N_4MnCl_3O_4H_2O$:
Calculated: C, 36.41; H, 7.25; N, 10.61.
Found: C, 36.56; H, 7.03; N, 10.57.

Preparation 6: Synthesis of $[Mn^{III}(\text{mes-14-decane})Cl_2]NO_3.H_2O$ 1.692 g of mes-14-decane was dissolved in 50 ml of ethanol, and to this solution, an addition of 1.482 g of $Mn(CH_3COO)_2.4H_2O$ in 50 ml of ethanol gave rise to a thick brown solution. The formed solution was stirred for 24 hours with the injection of air. To the stirred solution, concentrated hydrochloric acid and concentrated nitric acid were added to produce a yellow greenish solid. The solid was filtered and washed with ethanol, thus synthesizing yellow greenish $[Mn^{III}(\text{mes-14-decane})Cl_2]NO_3.H_2O$.

IR (KBr, cm-1): 3423, 3175, 3128, 2977, 1416, 1384.
Elemental analysis for $C_{16}H_{36}N_5MnCl_2O_3H_2O$:
Calculated: C, 39.19; H, 7.81; N, 14.28.
Found: C, 39.25; H, 7.99; N, 14.29.

Examples 1-5 And Comparative Examples 1-2

As set forth in Table 1 below, a bleach composition having no bleach activator added to sodium percarbonate was used as Comparative Example 1, and a composition having sodium percarbonate and tetraacetylethylenediamine as a bleach activator was used as Comparative Example 2. Also, bleach compositions having sodium percarbonate and each of the macrocyclic manganese complexes prepared in Preparations 4-6 were used as Examples 1-5. The bleaching activities of the macrocyclic manganese complexes prepared according to Preparations 4-6 in the bleach compositions were measured on tea, coffee, sugar beet, and red wine-stained fabrics. The measurement conditions are as follows:

Measurement device: Terg-O-Tometer
Washing temperature: 25° C.;
Washing water: distilled water containing CaCO3 in an amount to corresponding to a hardness of 90 ppm;
Washing time: 10 min (120 rpm)
Evaluation: The whiteness of the stained fabrics was measured with a specto color meter before and after the washing and expressed as a percentage based upon the washing ability of Comparative Example 1 taken as 100. The results are shown in Table 1 below.

TABLE 1

| | Comparative Example 1 | Comparative Example 2 | Example 1 | Example 2 | Example 3 | Example 4 | Example 5 |
|---|---|---|---|---|---|---|---|
| Sodium percarbonate (g) | 4.6 | 4.6 | 4.6 | 4.6 | 4.6 | 4.6 | 4.6 |
| TAED (g) | 0 | 0.4 | 0 | 0 | 0 | 0 | 0 |
| Manganese complex (g) of Preparation 4 | 0 | 0 | 0.04 | 0.004 | 0 | 0 | 0 |
| Manganese complex (g) of Preparation 5 | 0 | 0 | 0 | 0 | 0.04 | 0.004 | 0 |

TABLE 1-continued

| | Comparative Example 1 | Comparative Example 2 | Example 1 | Example 2 | Example 3 | Example 4 | Example 5 |
|---|---|---|---|---|---|---|---|
| Manganese complex (g) of Preparation6 | 0 | 0 | 0 | 0 | 0 | 0 | 0.04 |
| Washing ability (%) (tea) | 100 | 123 | 213 | 136 | 262 | 161 | 243 |
| Washing ability (%) (coffee) | 100 | 128 | 178 | 134 | 210 | 147 | 197 |
| Washing ability (%) (sugar beet) | 100 | 110 | 142 | 119 | 148 | 127 | 150 |
| Washing ability (%) (red wine) | 100 | 110 | 138 | 116 | 150 | 127 | 131 |

As can be seen in Table 1 above, Examples 1-5 comprising the inventive manganese complex showed a significantly high washing activity as compared to Comparative 1 having no bleach activator added to sodium percarbonate and Comparative Example 2 having TAED added to sodium percarbonate, even when the inventive manganese complex was used at a low temperature of 25° C. in amounts of 1/10-1/100 times the weight of TAED. This suggests that the macrocyclic manganese complexes of the present invention have a very excellent ability to activate bleaches.

Examples 6-8 and Comparative Example 3

As shown in Table 2 below, detergent compositions of Comparative Example 3 and Examples 6-8 were prepared by adding TAED and the macrocyclic manganese complexes prepared in Preparations 4-6, respectively, to 0.8 g of a commercially available concentrated detergent having no bleach and 0.15 g of sodium percarbonate. Then, the bleaching activities of the detergent compositions were evaluated on tea, coffee, sugar beet and curry-stained fabrics.

The test conditions are the same as in Examples 1-4.

TABLE 2

| | Comparative Example 3 | Example 6 | Example 7 | Example 8 |
|---|---|---|---|---|
| Concentrated detergent (g) | 0.8 | 0.8 | 0.8 | 0.8 |
| Sodium percarbonate (g) | 0.15 | 0.15 | 0.15 | 0.15 |
| TAED (g) | 0.05 | 0 | 0 | 0 |
| Manganese complex (g) of Preparation 4 | 0 | 0.00125 | 0 | 0 |
| Manganese complex (g) of Preparation 5 | 0 | 0 | 0.00125 | 0 |
| Manganese complex (g) of Preparation 6 | 0 | 0 | 0 | 0.00125 |
| Washing ability (%) (tea) | 100 | 119 | 133 | 132 |
| Washing ability (%) (coffee) | 100 | 119 | 121 | 124 |
| Washing ability (%) (sugar beet) | 100 | 117 | 121 | 119 |
| Washing ability (%) (curry) | 100 | 107 | 110 | 106 |

As can be seen in Table 2 above, Examples 6-8 comprising the macrocyclic manganese complex of the present invention showed a significantly high washing as compared to Comparative Example 3, that is the prior bleaching detergent composition containing sodium percarbonate and TAED, even though the macrocyclic manganese complexes were used in only 1/40 times the weight of TAED.

Example 9

Evaluation of Bleaching Ability in the Case of Excessive Addition

Compositions were prepared by adding $[Mn^{III}(rac\text{-}14\text{-}decane)Cl_2]ClO_4$ or $[Mn^{III}(mes\text{-}14\text{-}decane)Cl_2]ClO_4.H_2O$ prepared in Preparations 4-5 to 0.8 g of a commercially available concentrated detergent and 0.15 g of sodium percarbonate at varying concentrations as shown in Table 3 below. The washing abilities of the compositions were evaluated on tea-stained fabrics.

TABLE 3

| Manganese complex (g) of Preparation 4 or 5 | 0.0002 | 0.0005 | 0.0025 | 0.005 | 0.001 | 0.002 | 0.003 | 0.004 | 0.005 |
|---|---|---|---|---|---|---|---|---|---|
| Washing ability (%) of manganese complex of Preparation 4 | 100 | 99 | 132 | 179 | 201 | 224 | 231 | 251 | 250 |
| Washing ability (%) of manganese complex of Preparation 5 | 100 | 129 | 229 | 251 | 281 | 263 | 240 | 189 | 180 |

As can be seen in Table 3 above, $[Mn^{III}(rac\text{-}14\text{-}decane)Cl_2]ClO_4$ of Preparation 4 maintained almost constant bleaching ability with an increase in concentration, and $[Mn^{III}(mes\text{-}14\text{-}decane)Cl_2]ClO_4.H_2O$ of Preparation 5 showed a decrease in bleaching activity at more than a given concentration. This indicates that the bleach activators according to the present invention do not cause the excessive bleaching of fabrics even when they are added in an excessive amount. Thus, the inventive bleach activators do not cause damage to the dyes or fibers of clothes.

Preparations 7-10: Granulation of Bleach Activators

The granulation of bleach activators can be achieved by the use of a Lödige mixer™ or an extruder. Granulation in Preparations 7 and 8 were performed using the Lödige mixer™, and granulation in Preparations 9 and 10 was performed using the extruder. First, the manganese complexes prepared in Preparations 4 and 5 together with a disintegrant and a filler were placed and mixed in Lödige mixer™. When the components were mixed homogeneously, the upper lid of the mixer was opened and an aqueous binder solution was added into the mixer while operating only a main blade. The chopper was rotated to perform the granulation of the bleach activators. As particles with a suitable size are formed, a post-coating agent was added and the main blade and the chopper were operated to complete the granulation. In this respect, the compositions and concentrations of the disintegrant, filler and binder used in the granulation process, and other detail test conditions, are shown in Table 4 below. In Preparation Examples 9 and 10 conducted using the extruder, the corresponding raw materials including the manganese complexes of Preparations 4 and 5 were mixed homogeneously, to which an aqueous binder solution was then added. Then, granules with the same diameter were prepared by the extruder and formed to a given diameter by a Spheronizer. The prepared granules were dried to hot air drying using a fluid bed dryer.

TABLE 4

| Granulation conditions | | | | |
|---|---|---|---|---|
| | Preparation 7 | Preparation 8 | Preparation 9 | Preparation 10 |
| Manganese complex (g) | 300, Preparation 4 | 200 g, Preparation 5 | 200 g, Preparation 4 | 300 g, Preparation 5 |

TABLE 4-continued

| Granulation conditions | | | | |
|---|---|---|---|---|
| | Preparation 7 | Preparation 8 | Preparation 9 | Preparation 10 |
| Filler (g) | $Na_2SO_4$ 500 | NaCl 400 | NaCl 300 | $Na_2SO_4$ 300 |
| Binder (g) | PEG 120 | PVP K-30 120 | PVP K-30 120 | PEG 120 |
| Disintegrant (g) | SCMC 250 | Silica 250 | Silica 400 | SCMC 500 |
| Post-coating agent (g) | $TiO_2$ 70 | Zeolite-4A 70 | | |
| Revolution speed (rpm) of main blade | 140 | 140 | | |
| Revolution speed (rpm) of chopper | 3000 | 3000 | | |

Examples 10-11 and Comparative Examples 4-5

Evaluation of Storage Stability

In order to use the manganese complex granules of Examples 7-10 in bleach and detergent compositions, the complex granules were placed in vials and stored at 45° C. and 75% RH for 5 weeks. Then, the granules of the complexes in the vials were tested for long-term storage stability by the titration of active oxygen as compared with TAED. The test conditions are as follows and active oxygen was calculated according to the following equation.

Reagent 1: 55 ml of concentrated sulfuric acid was added to 500 ml of distilled water, and 100 g of $Al_2(SO_4)3.18H_2O$ and 1.6 g of $Bi(NO_3)_3.5H_2O$ were dissolved to prepare I liter of a solution.

Reagent 2: 1N $KMnO_4$ solution

Test conditions: the sample was precisely taken and placed in a 500 ml beaker. To the beaker, 100 ml of the reagent 1 and 300 ml of distilled water were added, followed by stirring. The reagent 2 was titrated to an end point to which a pale pink color lasted for 30 minutes. The amount of active oxygen was calculated according to the following equation 1:

$$\text{Amount of active oxygen (\%)} = 4 \times \text{volume of } KMnO_4 \text{ (ml)} \times \text{concentration of } KMnO_4 \text{ (N)} / 5 \times \text{amount of sample (g)} \quad \text{[Equation 1]}$$

TABLE 5

| | TAED (g) | Manganese complex (as actives, g) Preparation 7 | Preparation 9 | Concentrated detergent (g) | Sodium percarbonate (g) | Active oxygen |
|---|---|---|---|---|---|---|
| Comparative Example 4 | | | | 2.1 | 0.9 | 13.44 |

TABLE 5-continued

| | TAED | Manganese complex (as actives, g) | | Concentrated | Sodium percarbonate | Active |
|---|---|---|---|---|---|---|
| | (g) | Preparation 7 | Preparation 9 | detergent (g) | (g) | oxygen |
| Comparative Example 5 | 0.15 | | | 2.1 | 0.9 | 12.30 |
| Example 10 | | 0.00375 | | 2.1 | 0.9 | 12.27 |
| Example 11 | | | 0.00375 | 2.1 | 0.9 | 12.63 |

Examples 12-13 and Comparative Example 6

Evaluation of Long-Term Storage Stability

In order to use the dried manganese complex granules of Preparations 7-9 in bleaching and detergent compositions, the granules were formulated as shown in Table 6 below and stored at 45° C. and 70% RH for 5 weeks. Then, the long-term storage stability of bleach activators in the formulations was tested on various stained fabrics to be bleached, as compared with TAED. The test conditions were the same as in Examples 1-4, and the amount of manganese complexes was based on active components.

TABLE 6

| | Comparative Example 6 | | Example 12 | | Example 13 | |
|---|---|---|---|---|---|---|
| Concentrated detergent (g) | 0.67 | | 0.67 | | 0.67 | |
| Sodium percarbonate (g) | 0.28 | | 0.28 | | 0.28 | |
| TAED(g) | 0.05 | | | | | |
| Manganese complex (g) of Preparation 7 | | | 0.00125 | | | |
| Manganese complex (g) of Preparation 9 | | | | | 0.00125 | |
| Stained fabrics to be bleached | Initial | After storage | Initial | After storage | Initial | After storage |
| Washing ability (tea) | 100 | 100 | 101 | 133 | 98 | 134 |
| Washing ability (coffee) | 100 | 100 | 117 | 100 | 112 | 112 |
| Washing ability (sugar beet) | 100 | 100 | 110 | 116 | 107 | 121 |
| Washing ability (curry) | 100 | 100 | 105 | 111 | 102 | 109 |

As can be seen in Table 6 above, similarly to Comparative Example 5 or 6, that is the prior bleaching detergent composition containing sodium percarbonate and TAED, Examples 10 and 11 comprising the macrocyclic manganese complex of the present invention showed a slight decrease in the amount of initial active oxygen as compared with Comparative Example 4. However, as can be seen in Table 6 above, Examples 12 and 13 showed the equal or higher washing ability after 5 weeks as compared to Comparative Example 6, even when the bleach activator of the present invention was used in only 1/40 times the weight of TAED. This suggests that the compositions of Examples 12 and 13 have long-term storage stability.

Examples 14-15 and Comparative Example 7

Evaluation of Fabric Damage

Bleach activator-containing concentrated detergents were formulated at composition ratios as shown in Table 7 below. In accordance with a standard usage of the formulated detergents, color fabrics with various colors were washed 30 times in a top-loading washing machine (10 kg capacity) with 40° C. tap water. A change in the surface reflectivity of the dyed fabrics as compared a color difference with the initial state measured, and from the measurement results, the relative fading difference of each fabric was calculated according to the following equation 2. Also, the loss of warp and weft tensile strengths of each of the dyed fabrics were determined according to KS methods and averaged to evaluate the extent of fiber damage.

$$\Delta E=\sqrt{(\Delta L^2+\Delta a^2+\Delta b^2)} \quad \text{(Equation 2)}$$

TABLE 7

Evaluation of dye damage by calculation of decoloration of fibers

| | Comparative Example 7 | Example 14 | Example 15 |
|---|---|---|---|
| Concentrated detergent | 80% | 80% | 80% |
| Sodium percarbonate | 15% | 15% | 15% |
| TAED | 5% | | |
| Bleach activator of Preparation 7 | | 5% | |
| Bleach activator of Preparation 9 | | | 5% |
| Dyed fabric | Total color difference (⊿E) | | |
| Reactive Red 158 | 14.00 | 6.33 | 6.43 |
| Sulfur Blue 19 | 32.56 | 28.83 | 28.66 |
| Reactive Blue 225 | 17.32 | 10.14 | 10.37 |
| Direct Blue 71 | 5.39 | 5.18 | 4.98 |
| Direct Black 22 | 31.05 | 10.35 | 10.80 |

TABLE 8

Measurement of extent of fiber damage by measurement of tensile strength (unit: kgf/cm$^2$)

| Dyed fabric | Initial | Comparative Example 7 | Example 14 | Example 15 |
|---|---|---|---|---|
| Reactive Red 158 | 20.6 | 18.6 | 20.5 | 19.7 |
| Sulfur Blue 19 | 21.2 | 17.0 | 19.6 | 20.3 |
| Reactive Blue 225 | 20.9 | 18.0 | 19.5 | 18.8 |
| Direct Blue 71 | 21.4 | 17.4 | 19.6 | 20.2 |
| Direct Black 22 | 22.0 | 17.7 | 20.4 | 21.0 |
| EMPA 116 | 31.8 | 28.8 | 30.2 | 30.7 |

As shown in Tables 7 and 8, the results of recycled washing using Examples 14-15 with the same bleach activator concentration as TAED of Comparative Example 7 showed that Examples 14-15 had very good properties with respect to the dye fading and the fiber damage as compared with Comparative Example 7. In view of the fact that the bleach activators of the present invention actually show the equal or higher bleaching activity and storage stability at an amount of about 1/40 as compared with TAED, the inventive bleaching activators do not cause damage to the dyes or fibers of fabrics in commercial applications.

As described above, the macrocyclic manganese complexes according to the present invention are easily synthesized and have an excellent bleaching performance even in a low amount as compared with the prior bleaching activators. Also, the inventive bleaching activators are safer with respect to fabric damage and have a bleaching performance even at low temperature. Thus, the bleaching compositions and bleaching detergent compositions comprising the inventive bleach activators have a superior bleaching performance to that of the prior compositions.

It will be apparent to those skilled in the art that various modifications and variation can be made in the present invention without departing from the spirit or scope of the invention. Thus, it is intended that the present invention cover the modifications and variations of this invention provided that they come within the scope of the appended claims and their equivalents.

What is claimed is:

1. A bleaching detergent composition comprising a peroxide, a surfactant, a builder and 0.001-5% by weight of a bleach activator, the bleach activator being at least one selected from the group consisting of $[Mn^{III}(rac\text{-}14\text{-}decane)X_2]Y$, $[Mn^{III}(mes\text{-}14\text{-}decane)X_2]Y.H_2O$ and $[Mn^{III}(mes\text{-}14\text{-}decane)X_2]Y$ (represented by Formulas 1-3:

[Formula 1]

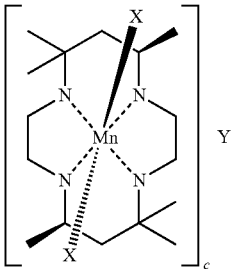

$[Mn^{III}(rac\text{-}14\text{-}decane)X_2]Y$

-continued

[Formula 2]

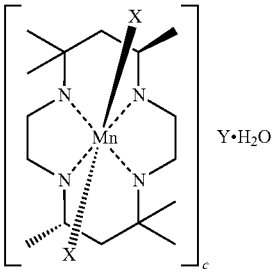

$[Mn^{III}(mes\text{-}14\text{-}decane)X_2]Y\cdot H_2O$

[Formula 3]

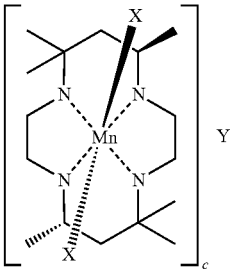

$[Mn^{III}(mes\text{-}14\text{-}decane)X_2]Y$ wherein X is at least one selected from chlorine (—Cl) and acetate (—$OOCCH_3$), and Y is an anion selected from $Cl^-$, $Br^-$, $F^-$, $NO_3^-$, $ClO_4^-$, $OH^-$, $NCS^-$, $N_3^-$, and $PF_6^-$.

* * * * *